US012397883B2

(12) United States Patent
Meza et al.

(10) Patent No.: US 12,397,883 B2
(45) Date of Patent: Aug. 26, 2025

(54) QUICK RELEASE MOTOR PUMP ASSEMBLY FOR ELECTRIC MARINE TOILET

(71) Applicant: FLOW CONTROL LLC, Beverly, MA (US)

(72) Inventors: Humberto V. Meza, Trabuco Canyon, CA (US); Matthew Edmond, Hitchin (GB)

(73) Assignee: FLOW CONTROL LLC, Beverly, MA (US)

( * ) Notice: Subject to any disclaimer, the term of this patent is extended or adjusted under 35 U.S.C. 154(b) by 727 days.

(21) Appl. No.: 17/026,584

(22) Filed: Sep. 21, 2020

(65) Prior Publication Data

US 2022/0089255 A1 Mar. 24, 2022

Related U.S. Application Data

(60) Provisional application No. 62/902,580, filed on Sep. 19, 2019.

(51) Int. Cl.
*B63B 29/14* (2006.01)
*E03D 5/01* (2006.01)

(52) U.S. Cl.
CPC ..... *B63B 29/14* (2013.01); *E03D 5/01* (2013.01)

(58) Field of Classification Search
CPC ..... B63B 29/14; E03D 5/01; E03D 5/00
(Continued)

(56) References Cited

U.S. PATENT DOCUMENTS 953,061 A 3/1910 Ruland
2,021,241 A * 11/1935 Mall ..... F16C 1/08 285/308

(Continued)

FOREIGN PATENT DOCUMENTS

EP 0593937 A1 4/1994
EP 1850049 A2 10/2007

(Continued)

OTHER PUBLICATIONS

WO-2007124736-A2 Translation (Year: 2023).*

(Continued)

*Primary Examiner* — David P Angwin
*Assistant Examiner* — William R Klotz
(74) *Attorney, Agent, or Firm* — William J. Barber; WARE FRESSOLA MAGUIRE & BARBER LLP

(57) ABSTRACT

Apparatus featuring a toilet base having a wall forming a chamber for receiving waste, the wall having a toilet base coupling portion; a pump/motor assembly having a pump inlet configured to receive the waste pumped from the chamber, the pump inlet having a pump inlet coupling portion arranged inside the toilet base coupling portion when the pump/motor assembly and the toilet base are coupled together; and a quick release coupling mechanism having a clip receiving portion and a clip configured to slide within the clip receiving portion from a disengage position to an engage position to engage the pump inlet coupling portion and couple the toilet base and the pump/motor assembly together, and also configured to slide from the engage position to the disengage position to disengage the pump inlet coupling portion and decouple the pump/motor assembly from the toilet base.

18 Claims, 14 Drawing Sheets

(58) Field of Classification Search
USPC ..... 4/300, 431; 285/305
See application file for complete search history.

(56) References Cited

U.S. PATENT DOCUMENTS

| | | | | |
|---|---|---|---|---|
| 3,514,231 | A | 5/1970 | Belden | |
| 3,699,592 | A | 10/1972 | Minchak | |
| 4,244,608 | A * | 1/1981 | Stuemky | F16L 37/144 285/305 |
| 4,559,136 | A | 12/1985 | Dockery | |
| 4,672,690 | A | 6/1987 | Sigler | |
| 4,867,871 | A | 9/1989 | Bowne | |
| 5,044,883 | A | 9/1991 | Neueder | |
| 5,593,187 | A * | 1/1997 | Okuda | F28F 9/0256 285/914 |
| 5,782,508 | A | 7/1998 | Bartholomew | |
| 5,797,627 | A | 8/1998 | Salter et al. | |
| 5,964,483 | A | 10/1999 | Long et al. | |
| 6,085,364 | A | 7/2000 | Baierlein | |
| 6,161,578 | A | 12/2000 | Braun et al. | |
| 6,908,123 | B2 | 6/2005 | Le | |
| 7,445,249 | B2 | 11/2008 | Feger et al. | |
| 7,530,605 | B2 * | 5/2009 | Rigollet | F16L 37/144 285/305 |
| 8,087,451 | B2 | 1/2012 | Gammons | |
| 8,256,743 | B2 | 9/2012 | Tiberghien et al. | |
| 8,348,582 | B2 * | 1/2013 | Bithell | F16L 37/144 24/522 |
| 8,840,150 | B2 | 9/2014 | Sierad et al. | |
| 8,944,473 | B2 | 2/2015 | Lutzke et al. | |
| 9,068,567 | B2 | 6/2015 | Hitter et al. | |
| 9,115,486 | B2 | 8/2015 | Rakoczy et al. | |
| 9,115,834 | B2 | 8/2015 | Parks et al. | |
| 9,157,560 | B2 | 10/2015 | Rehder et al. | |
| 9,371,136 | B2 | 6/2016 | Beach et al. | |
| 9,506,592 | B2 | 11/2016 | Turnau, III et al. | |
| 9,714,733 | B2 | 7/2017 | Wall | |
| 9,964,247 | B2 | 5/2018 | Rosin et al. | |
| 10,113,676 | B2 | 10/2018 | Bush et al. | |
| 10,404,013 | B2 | 9/2019 | Zhang et al. | |
| 2004/0051313 | A1 | 3/2004 | Trouyet | |
| 2004/0178629 | A1 * | 9/2004 | Yoshida | F16L 37/0885 285/305 |
| 2009/0058083 | A1 * | 3/2009 | Dorman | F16L 37/144 285/305 |
| 2013/0205489 | A1 | 8/2013 | Rakoczy | |
| 2017/0045169 | A1 | 2/2017 | Gibelin et al. | |
| 2017/0362808 | A1 | 12/2017 | Snyder et al. | |
| 2018/0112807 | A1 | 4/2018 | Erb | |

FOREIGN PATENT DOCUMENTS

| | | | | |
|---|---|---|---|---|
| JP | H10316086 | A | 12/1998 | |
| WO | 2006/102871 | A1 | 10/2006 | |
| WO | WO-2007124736 | A2 * | 11/2007 | B63B 29/14 |
| WO | 2019/115591 | A1 | 6/2019 | |

OTHER PUBLICATIONS

"Amarine-made 12V Quick Release RV Mount Macerator Waste Water Pump 45 LPM 12GPM Boat RV Marine," amazon.com. Feb. 20, 2019. https://web.archive.org/web/20191002025457/https://www.amazon.com/Amarine-made-Quick-Release-Macerator-Marine/dp/B06XWVMPGH; see images.

"APC Series, Straight-Through, Inline Coupler, For Use With APC Inserts," grainger.com. Feb. 10, 2019. https://web.archive.org/web/20191002020809/https://www.grainger.com/product/COLDER-APC-Series-23MG78; see images.

Qwik Jon Ultima 203 Systems Installation Instructions Preinstallation Checklist, s3.amazonaws.com. Feb. 10, 2019. https://web.archive.org/web/20191002022947/https://s3.amazonaws.com/pumpproducts/pdf/421_2_Zoeller+202-0005+Product+Instructions.pdf; p. 3.

English translation of JPH10316086A.

* cited by examiner

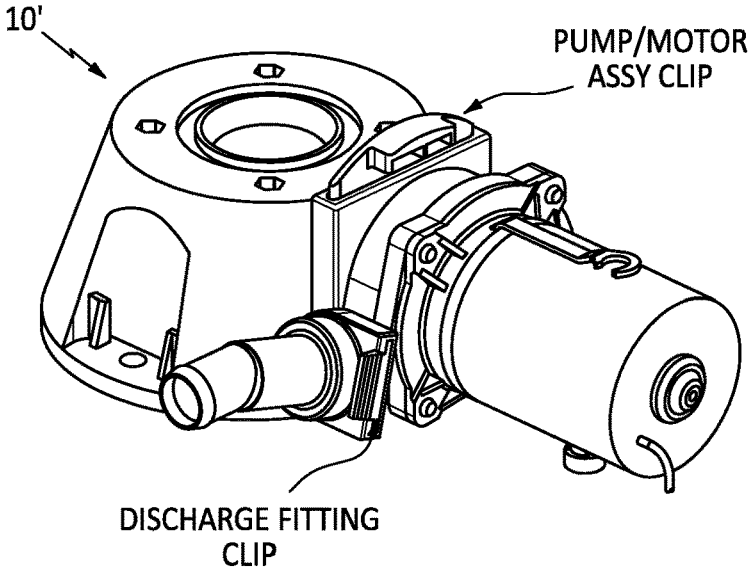
*FIG. 2C1*
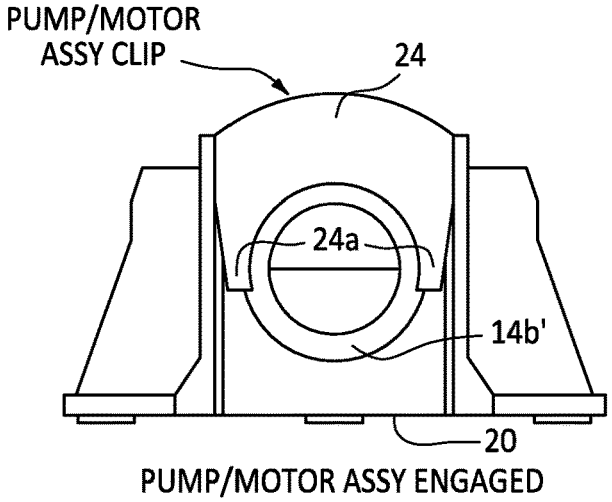
*FIG. 2C2*
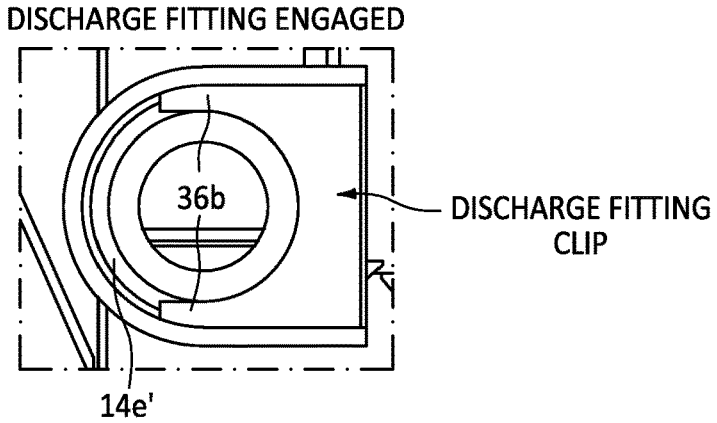
*FIG. 2C3*

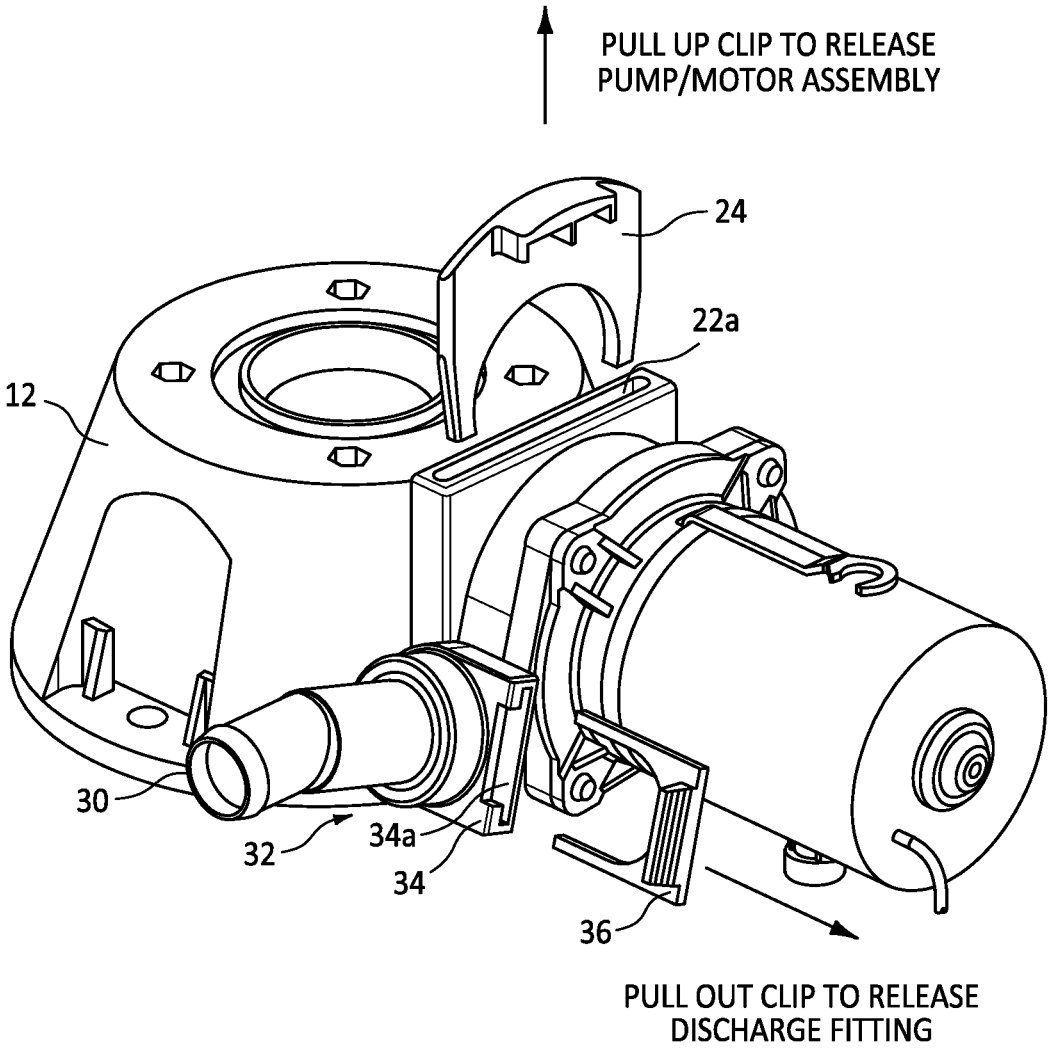
*FIG. 2D1*

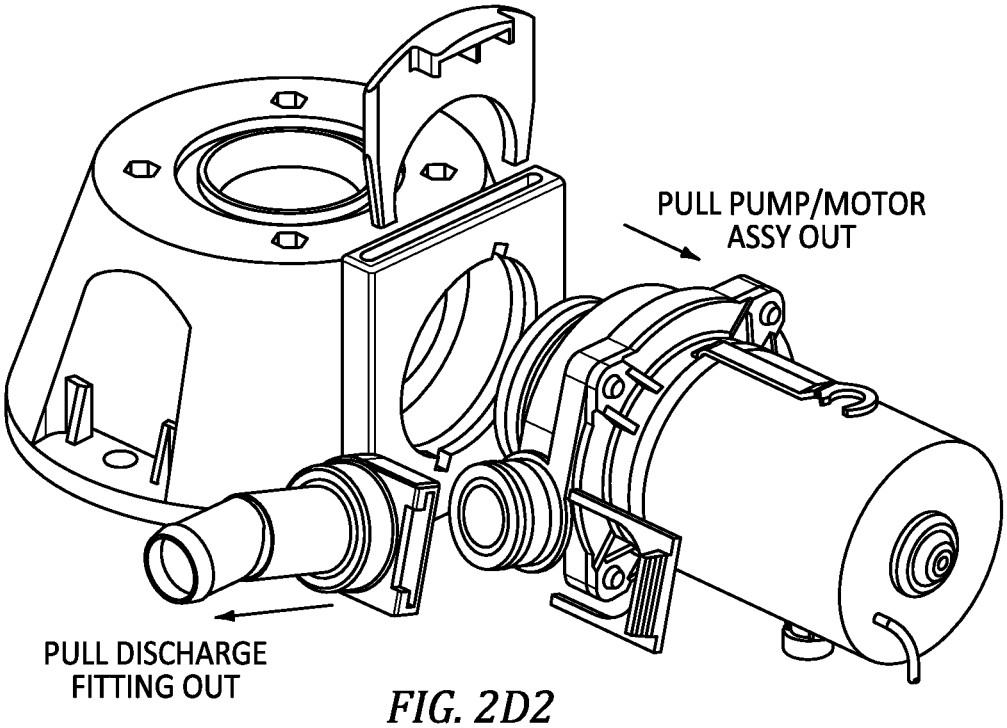
FIG. 2D2
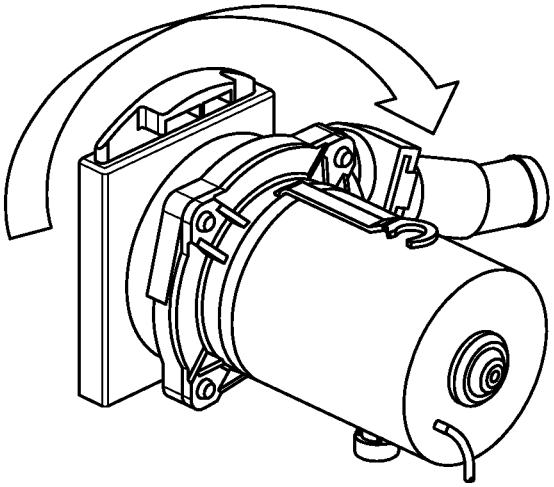
FIG. 2E1
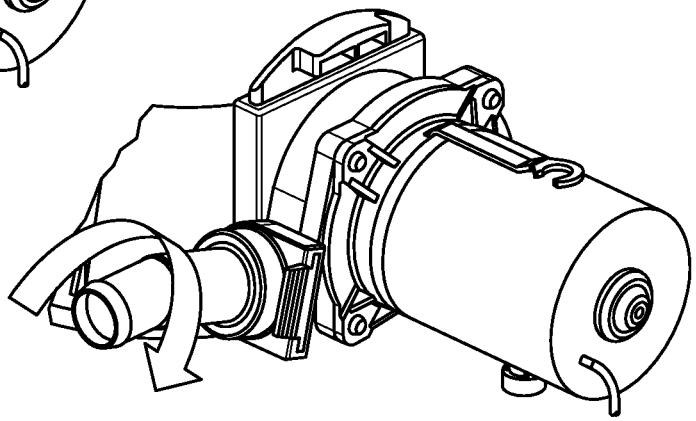
FIG. 2E2

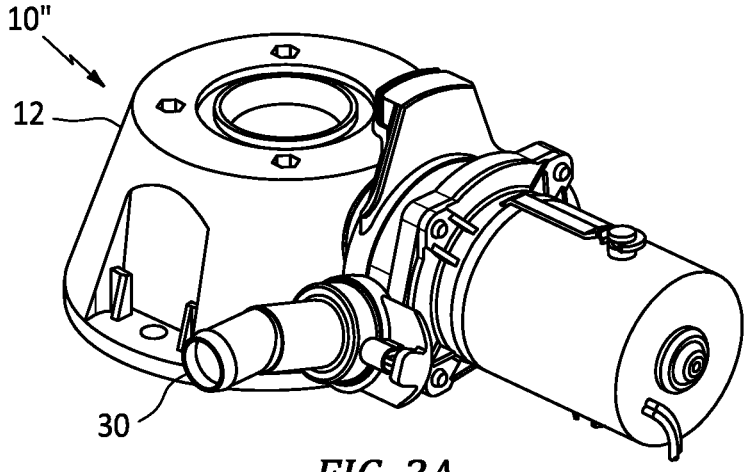
FIG. 3A
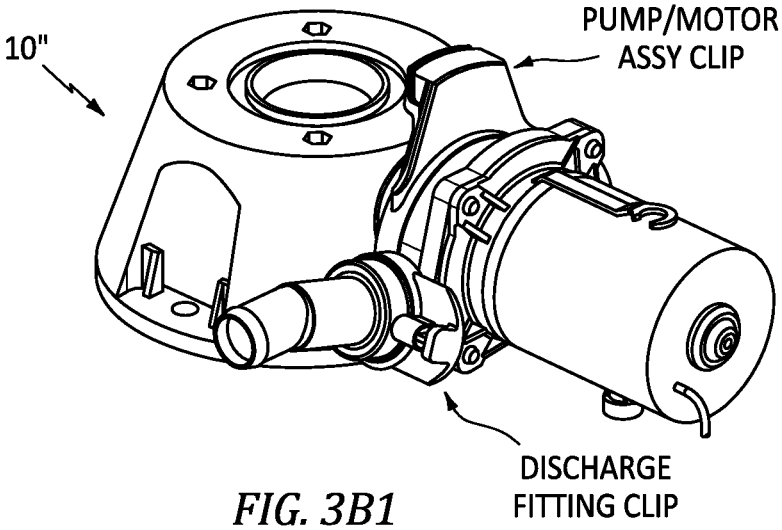
FIG. 3B1
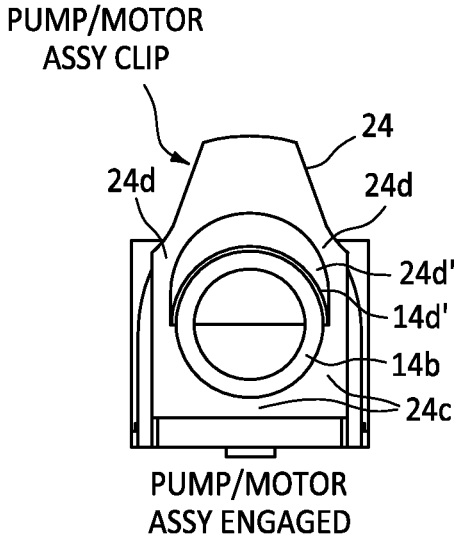
FIG. 3B2
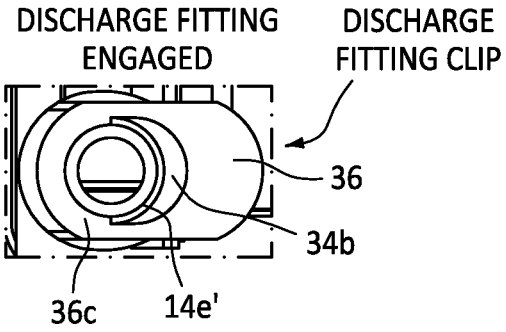
FIG. 3B3

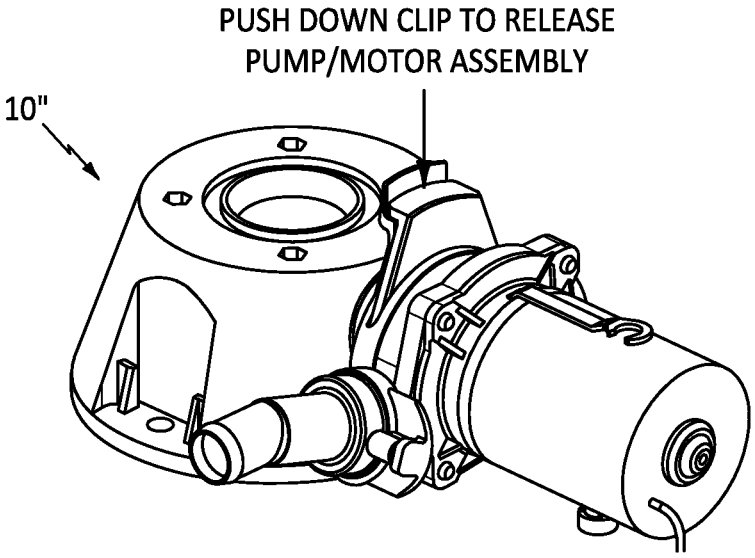
FIG. 3C1
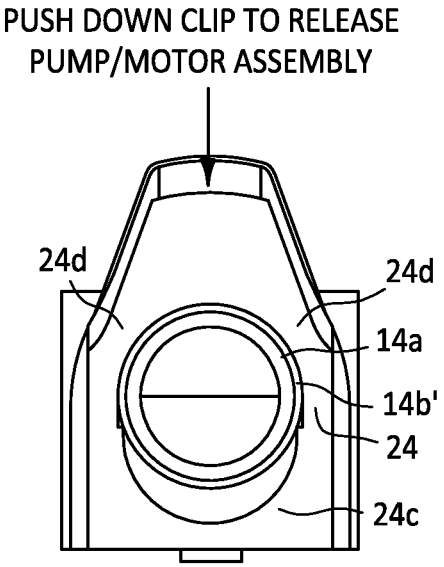
FIG. 3C2
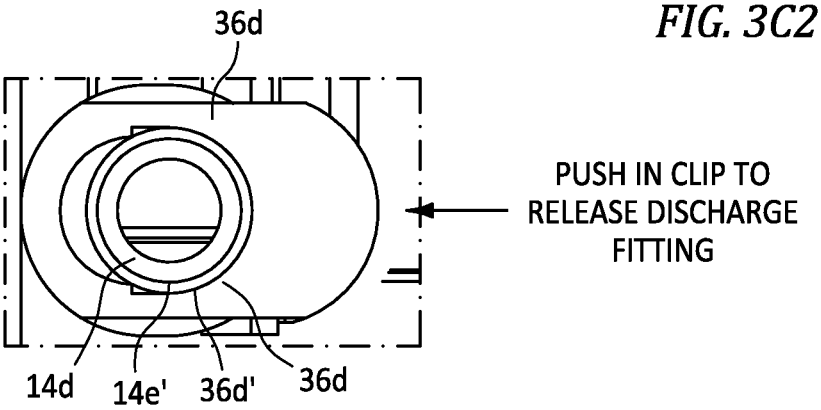
FIG. 3C3

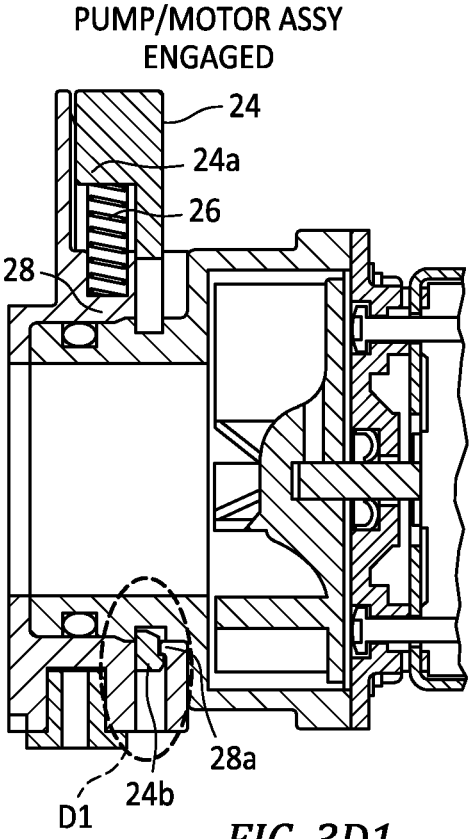
FIG. 3D1
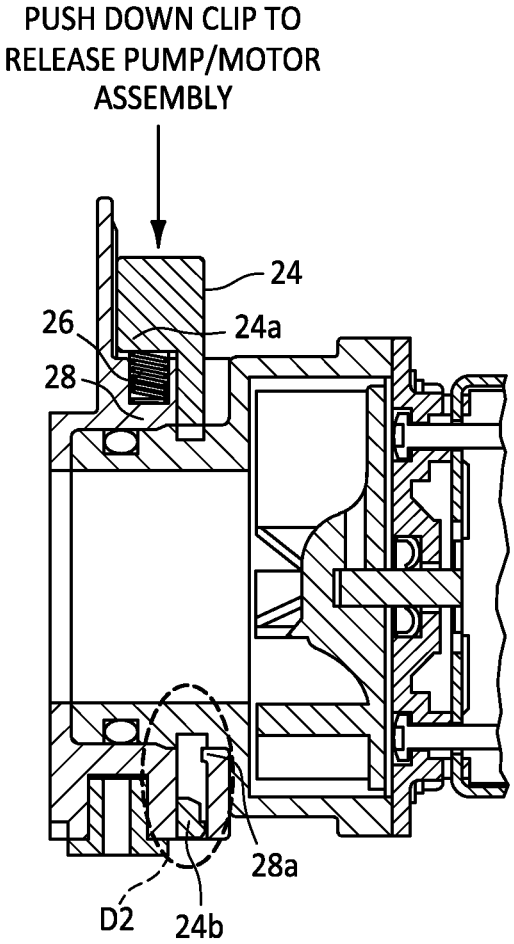
FIG. 3D2

QUICK RELEASE MOTOR PUMP ASSEMBLY FOR ELECTRIC MARINE TOILET

CROSS-REFERENCE TO RELATED APPLICATION

This application claims benefit to provisional patent application Ser. No. 62/902,580, filed 19 Sep. 2019, which is hereby incorporated by reference in its entirety.

BACKGROUND OF THE INVENTION

1. Field of the Invention

The present invention relates to apparatus having a toilet coupled to a motor/pump assembly, including where the toilet is an electric marine toilet.

2. Brief Description of Related Art

There is no product known to the inventors that allows a user to release the pump/motor assembly from a toilet base to enable fast access to service/maintain the toilet. In view of this, there is a need in the industry for a better way to release a motor/pump assembly from a toilet to enable fast access to service/maintain the toilet.

SUMMARY OF THE PRESENT INVENTION

In summary, the present invention provides a toilet base assembly that allows a user to perform fast servicing without the use of tools. On all electric marine toilets known the inventors, a series of screws have to be removed to allow access to the pump housing and impeller to remove blockages or service the toilet. According to the present invention, the pump/motor assembly will be removed by releasing a clip mechanism that holds the pump/motor assembly in place when in operation. The clip mechanism may include a clip that is manually inserted and removed, as well as a spring loaded clip.

PARTICULAR EMBODIMENTS

By way of example, and according to some embodiments, the present invention may include, or take the form of, apparatus featuring a toilet base, a pump/motor assembly and a quick release coupling mechanism.

The toilet base has a wall forming a chamber for receiving waste, the wall having a toilet base coupling portion.

The pump/motor assembly may include a pump inlet configured to receive the waste pumped from the chamber. The pump inlet may include a pump inlet coupling portion arranged inside the toilet base coupling portion when the pump/motor assembly and the toilet base are coupled together.

The quick release coupling mechanism may include a clip receiving portion and a clip. The clip may be configured to slide within the clip receiving portion from a disengage position to an engage position to engage the pump inlet coupling portion and couple the toilet base and the pump/motor assembly together. The clip may also be configured to slide from the engage position to the disengage position to disengage the pump inlet coupling portion and to decouple the pump/motor assembly from the toilet base.

Other Features

The apparatus may include one or more of the following features:

The quick release coupling mechanism may be mounted on the toilet base, and/or may form part of the toilet base coupling portion. By way of further example, embodiments are envisioned, and the scope of the invention is intended to include, mounting or configuring the quick release coupling mechanism on the pump/motor assembly, e.g., and having a corresponding toilet base coupling portion arranged inside a corresponding pump inlet coupling portion.

The clip receiving portion may include a slot configured or formed therein to receive the clip; and the clip may be configured to slide within the slot of the clip receiving portion.

The clip receiving portion may include an opening configured or formed therein; the pump inlet coupling portion may include a rim configured to pass through the opening formed in the clip receiving portion and into the toilet base coupling portion of the wall of the toilet base. The clip may be configured to slide within the clip receiving portion from the disengage position to the engage position and engage the rim to couple together the toilet base and the pump/motor assembly.

The quick release coupling mechanism may include a spring configured to expand when the clip slides from the disengage position to the engage position to push and hold the clip in the engage position, and also configured to compress when the clip slides from the engage position to the disengage position to urge the spring back towards the engage position when the clip is released.

The clip may include a clip engaging portion configured to engage the rim when the clip slides from the disengage position to the engage position, and also configured to disengage the rim when the clip slides from the engage position to the disengage position.

The clip may include a clip release portion having an opening configured to allow the pump inlet coupling portion to pass thru when the clip slides into the disengage position for releasing the pump/motor assembly from the toilet base, and also for positioning the pump inlet coupling portion for engagement.

The pump/motor assembly may include a pump outlet having a pump outlet coupling portion configured or formed thereon to provide the waste from the pump/motor assembly. The apparatus may include a discharge fitting having a quick release discharge fitting coupling mechanism with a discharge fitting clip receiving portion and a discharge fitting clip. The discharge fitting clip may be configured to slide within the discharge fitting clip receiving portion from a discharge fitting disengage position to a discharge fitting engage position to engage the pump outlet coupling portion and couple the discharge fitting and the pump/motor assembly together. The discharge fitting clip may also be configured to slide from the discharge fitting engage position to the discharge fitting disengage position to disengage the pump outlet coupling portion and decouple the discharge fitting from the pump/motor assembly.

The discharge fitting clip receiving portion may include a discharge fitting slot configured or formed therein to receive the discharge fitting clip; and the discharge fitting clip may be configured to slide within the discharge fitting slot.

The discharge fitting clip receiving portion may include an opening configured or formed therein. The pump outlet coupling portion may include a pump outlet rim configured to pass through the opening formed in the discharge fitting clip receiving portion and into the discharge fitting. The discharge fitting clip may be configured to slide within the discharge fitting clip receiving portion from the discharge fitting disengage position to the discharge fitting engage position to engage the pump outlet rim to couple together the pump/motor assembly and the discharge fitting.

The quick release discharge fitting coupling mechanism may include a discharge fitting spring that is configured to expand when the discharge fitting clip slides from the discharge fitting disengage position to the discharge fitting engage position to push and hold the discharge fitting clip in the discharge fitting engage position. The discharge fitting spring may also be configured to compress when the discharge fitting clip slides from the discharge fitting engage position to the discharge fitting disengage position to urge the discharge fitting spring back towards the discharge fitting engage position. The discharge fitting clip may include a discharge fitting clip engaging portion configured to engage the pump outlet rim when the discharge fitting clip slides from the discharge fitting disengage position to the discharge fitting engage position, and also configured to disengage the pump outlet rim when the discharge fitting clip slides from the discharge fitting engage position to the discharge fitting disengage position. The discharge fitting clip may include a discharge fitting release portion having an opening configured to allow the pump outlet coupling portion to pass thru when the discharge fitting clip slides into the discharge fitting disengage position for releasing the discharge fitting from the pump/motor assembly, and for also positioning the pump outlet coupling portion for engagement.

The apparatus may include an electric toilet, e.g., such as a marine electric toilet or an RV electric toilet.

BRIEF DESCRIPTION OF THE DRAWING

The drawing, which is not necessarily drawn to scale, includes the following Figures:

FIG. 2C1 shows a perspective view of the apparatus shown in FIG. 2A as assembled, e.g., having the clip pushed in for coupling the pump/motor assembly and the toilet base, and also having the discharge fitting clip pushed in for coupling the discharge fitting and the pump/motor assembly, according to some embodiments of the present invention.

FIG. 2C2 is a cross-sectional view of a quick release coupling mechanism showing the clip engaging part of a pump inlet of the pump/motor assembly shown in FIG. 2C1 for connecting the pump/motor assembly to the toilet base, according to some embodiments of the present invention.

FIG. 2C3 is a cross-sectional view of a quick release discharge fitting coupling mechanism showing the discharge fitting clip engaging part of a pump outlet of the pump/motor assembly shown in FIG. 2C1 for connecting the pump/motor assembly and the discharge fitting, according to some embodiments of the present invention.

FIG. 2D1 shows a perspective view of the apparatus shown in FIG. 2C1, e.g., having the clip pulled out for disengaging the clip from part of the pump inlet of the pump/motor assembly and releasing the pump/motor assembly from the toilet base, and also having the discharge fitting clip pulled out for disengaging the discharge fitting clip from part of the pump outlet of the pump/motor assembly and releasing the discharge fitting from the pump/motor assembly, according to some embodiments of the present invention.

FIG. 2D2 shows an exploded view of the apparatus shown in FIG. 2D1, e.g., having the pump/motor assembly pulled out from the toilet base, and also having the discharge fitting pulled out of the pump outlet of the pump/motor assembly, according to some embodiments of the present invention.

FIG. 2E1 shows a partial perspective view of the apparatus shown in FIG. 2C1, e.g., having a discharge fitting configured to be rotated between 0°-180° in relation to, and about a longitudinal axis of, the pump inlet, to orient the discharge fitting in opposite directions as needed depending on the application, according to some embodiments of the present invention.

FIG. 2E2 shows a partial perspective view of the apparatus shown in FIG. 2C1, e.g., having the discharge fitting configured to be rotated 360° in relation to, and about a corresponding longitudinal axis of, the pump outlet, to swivel the discharge fitting as needed depending on the application, according to some embodiments of the present invention.

FIG. 3A shows a photograph of apparatus, including a quick release pump/motor assembly connected to a toilet base that may form part of an electric marine toilet, according to some embodiments of the present invention.

FIG. 3B1 shows a perspective view of the apparatus shown in FIG. 3A, e.g., having a clip and spring configuration for engaging/releasing part of a pump inlet of a pump/motor assembly for connecting the pump/motor assembly to/from the toilet base, and also having a discharge fitting clip and spring configuration for engaging/releasing part of a pump outlet for connecting the discharge fitting to/from the pump/motor assembly, according to some embodiments of the present invention.

FIG. 3B2 is a cross-sectional view of the quick release coupling mechanism showing the clip engaging part of the pump inlet of the pump/motor assembly shown in FIG. 3B1 for coupling the pump/motor assembly and the toilet base, according to some embodiments of the present invention.

Figure 1:
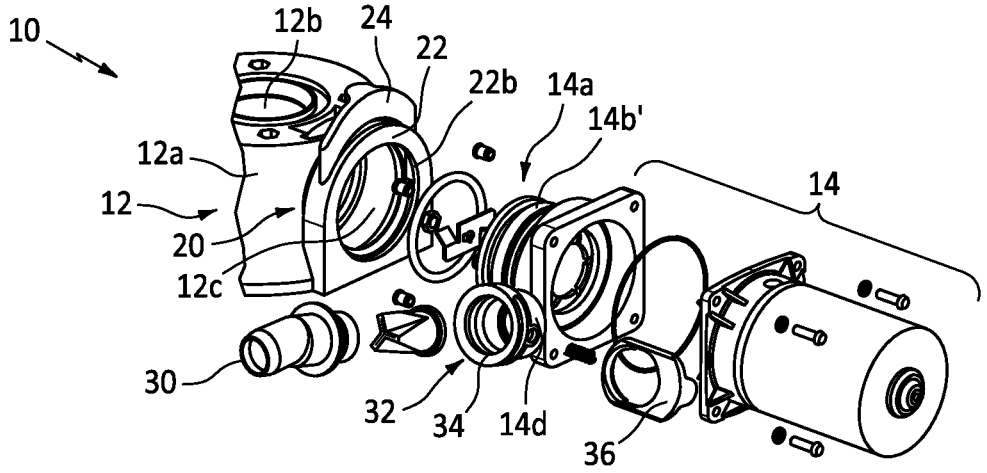
FIG. 1 shows an exploded view of apparatus having a quick release pump/motor assembly connected to a toilet base that may form part of an electric marine toilet, e.g., having a clip for engaging/releasing the pump/motor assembly to/from the toilet base, and having a discharge fitting clip with a spring configuration for engaging/releasing a discharge fitting to/from the pump/motor assembly, according to some embodiments of the present invention.
Figure 2A:
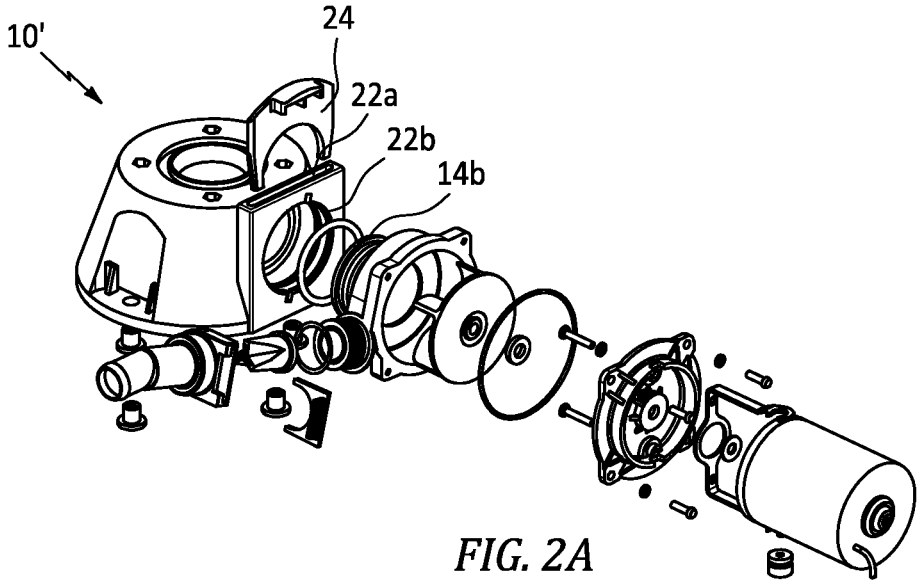
FIG. 2A shows an exploded view of apparatus including a quick release pump/motor assembly connected to a toilet base that may form part of an electric marine toilet, e.g., having a clip for engaging/releasing a pump/motor assembly to/from the toilet base, and having a discharge fitting clip for engaging/releasing a discharge fitting to/from the pump/motor assembly, according to some embodiments of the present invention.
Figure 2B:
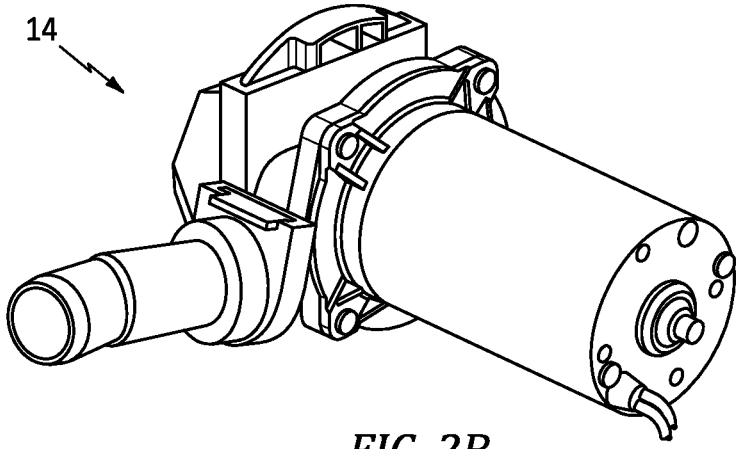
FIG. 2B shows a photograph of the quick release pump/motor assembly shown in FIG. 2A as assembled for connecting to the toilet base, according to some embodiments of the present invention.
Figure 2F:
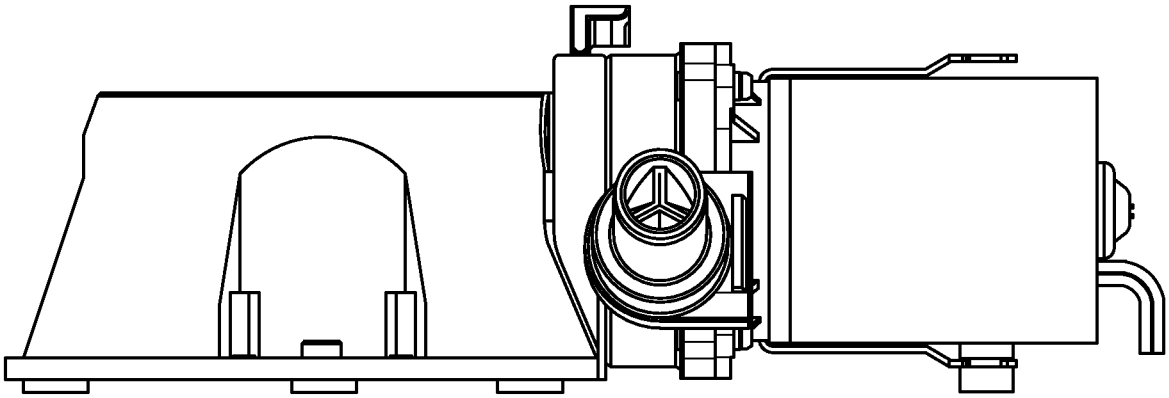
FIG. 2F shows a side view of the apparatus shown in FIG. 2C1, according to some embodiments of the present invention.
Figure 2G:
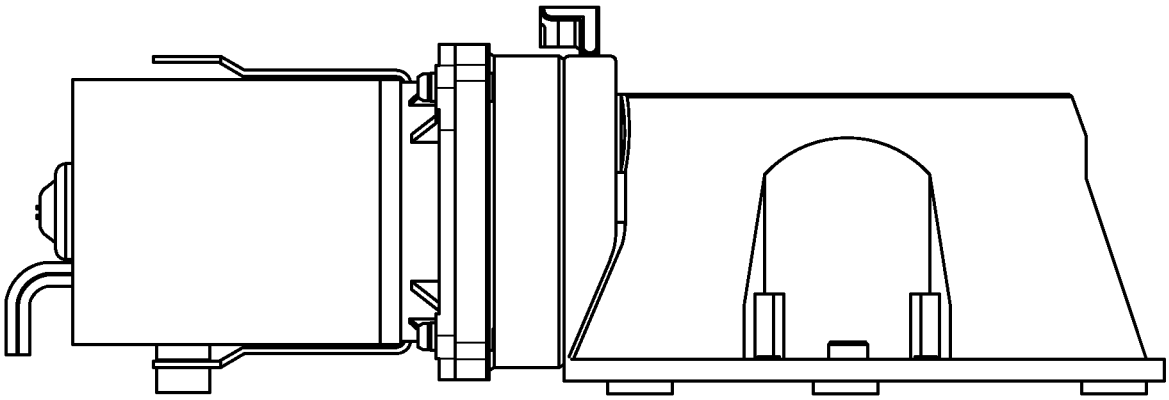
FIG. 2G shows a corresponding side view of the apparatus shown in FIG. 2C1 from the opposite side, according to some embodiments of the present invention.
Figure 2H:
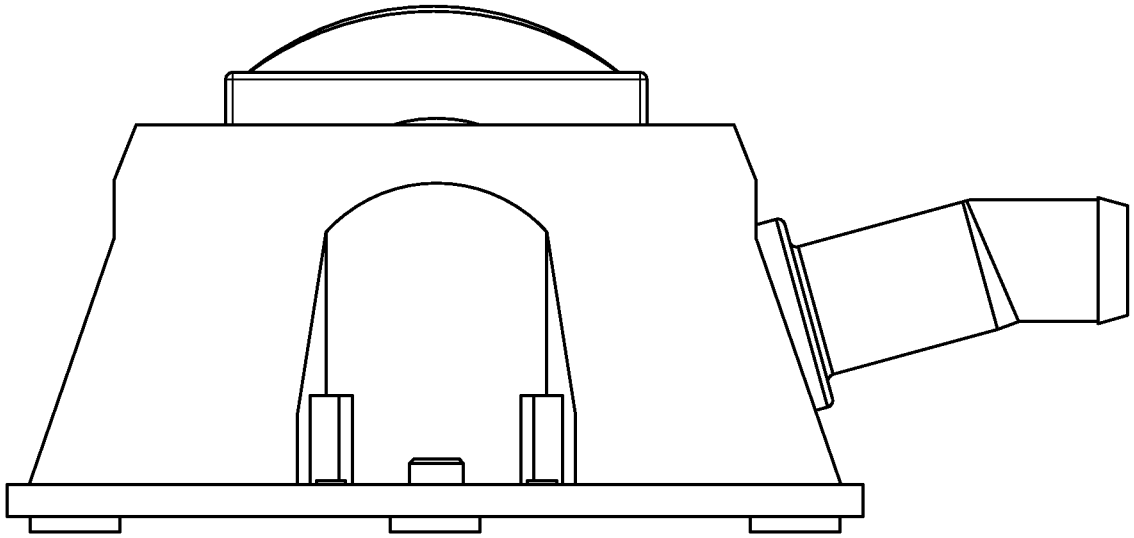
FIG. 2H shows a back view of the apparatus shown in FIG. 2C1, according to some embodiments of the present invention.
Figure 2I:
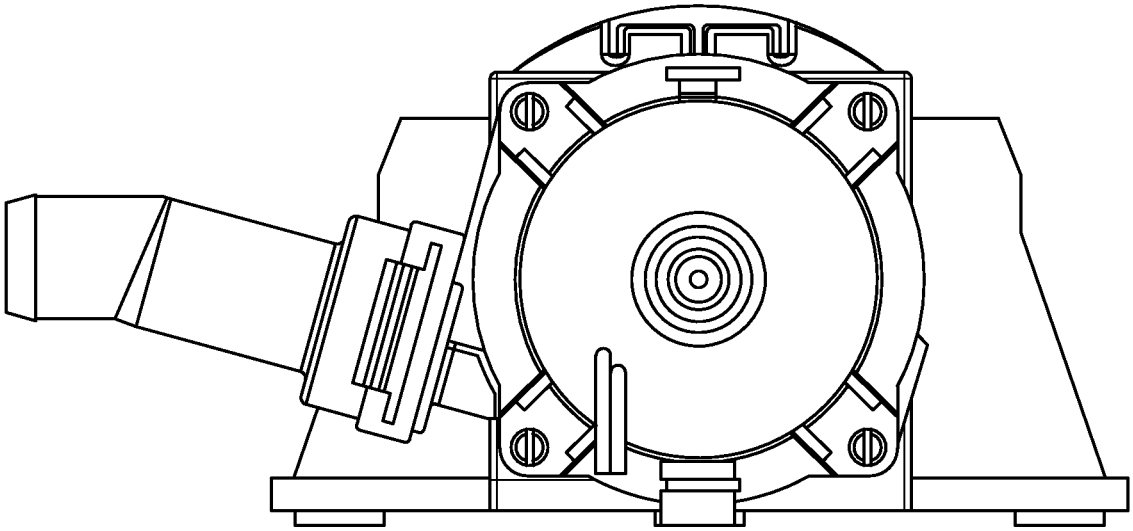
FIG. 2I shows a front view of the apparatus shown in FIG. 2C1, according to some embodiments of the present invention.
Figure 2J:
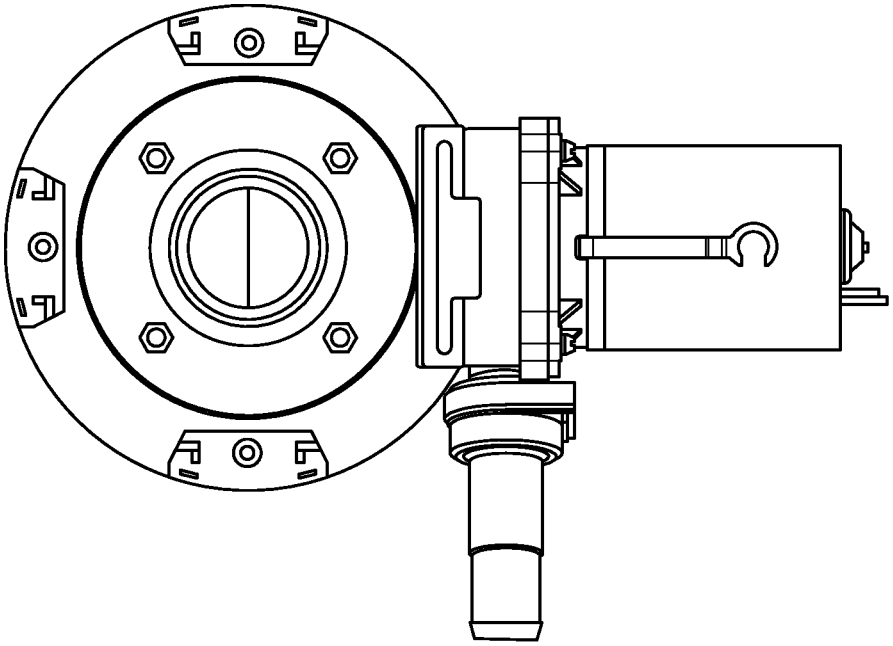
FIG. 2J shows a top view of the apparatus shown in FIG. 2C1, according to some embodiments of the present invention.
Figure 2K:
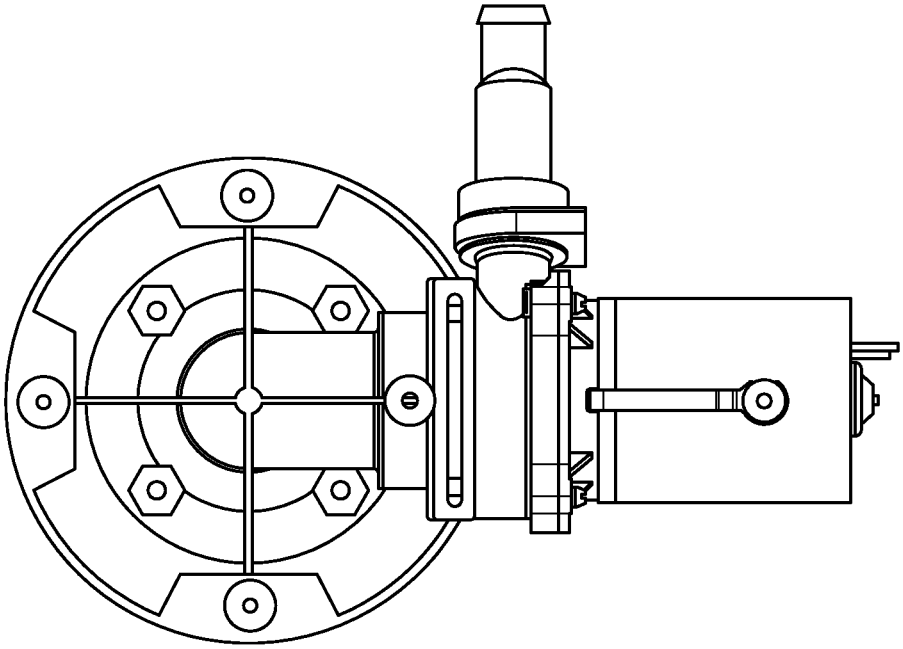
FIG. 2K shows a bottom view of the apparatus shown in FIG. 2C1, according to some embodiments of the present invention.

FIG. 3B3 is a cross-sectional view of the quick release discharge fitting coupling mechanism showing the discharge fitting clip engaging part of the pump outlet of the pump/motor assembly shown in FIG. 3B1 for coupling the discharge fitting and pump/motor assembly, according to some embodiments of the present invention.

FIG. 3C1 shows a perspective view of the apparatus shown in FIG. 3A, e.g., having the clip pushed in for compressing the spring, disengaging the clip from part of the pump inlet of the pump/motor assembly, and releasing the pump/motor assembly from the toilet base, and also having the discharge fitting clip pushed in for compressing the discharge fitting spring, disengaging the discharge fitting clip from part of the pump outlet of the pump/motor assembly, and releasing the discharge fitting from part of the pump outlet of the pump/motor assembly, according to some embodiments of the present invention.

FIG. 3C2 is a cross-sectional view of the quick release coupling mechanism showing the clip engaging part of the pump inlet of the pump/motor assembly shown in FIG. 3C1 for connecting the pump/motor assembly to the toilet base, according to some embodiments of the present invention.

FIG. 3C3 is a cross-sectional view of the quick release discharge fitting coupling mechanism showing the discharge fitting clip engaging part of the pump outlet of the pump/motor assembly shown in FIG. 3C1 for coupling the pump/motor assembly to the discharge fitting, according to some embodiments of the present invention.

FIG. 3D1 is a cross-sectional view showing part of the pump/motor assembly and the quick release coupling mechanism shown in FIG. 3C1, e.g., having the clip pushed out by the spring for engaging part of the pump inlet of the pump/motor assembly and for coupling the pump/motor assembly and the toilet base, according to some embodiments of the present invention.

FIG. 3D2 is a cross-sectional view showing part of the pump/motor assembly and the quick release coupling mechanism shown in FIG. 3C1, e.g., having the clip pushed in for compressing the spring, disengaging the clip from part of the pump inlet of the pump/motor assembly, and releasing the pump/motor assembly from the toilet base, according to some embodiments of the present invention. (In FIG. 3D2, the seven (7) "phantom" dots shown in the clip indicate where the spring extended before being compressed, and do not indicate any connection between the clip and the pump/motor assembly spring.)

FIG. 3E1 is a cross-sectional view of part of the pump/motor assembly and the quick release discharge fitting coupling mechanism shown in FIG. 3C1, e.g., having the discharge fitting clip pushed out by the discharge fitting spring for engaging part of the pump outlet of the pump/motor assembly and for coupling the discharge fitting and the pump/motor assembly, according to some embodiments of the present invention.

FIG. 3E2 is a cross-sectional view of part of the pump/motor assembly and the quick release discharge fitting coupling mechanism shown in FIG. 3C1, e.g., having the discharge fitting clip pushed in for compressing the discharge fitting spring, disengaging the discharge fitting clip from part of the pump outlet of the pump/motor assembly, and releasing the discharge fitting from the pump/motor assembly, according to some embodiments of the present invention. (In FIG. 3E2, the six (6) "phantom" dots shown in the discharge fitting clip indicate where the discharge fitting spring extended before being compressed, and do not indicate any connection between the discharge fitting clip and the discharge fitting spring.)

Figure 3F:
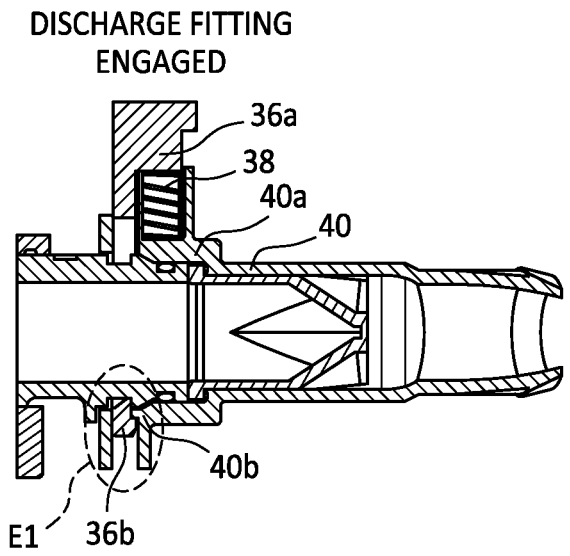
Figure 3F:
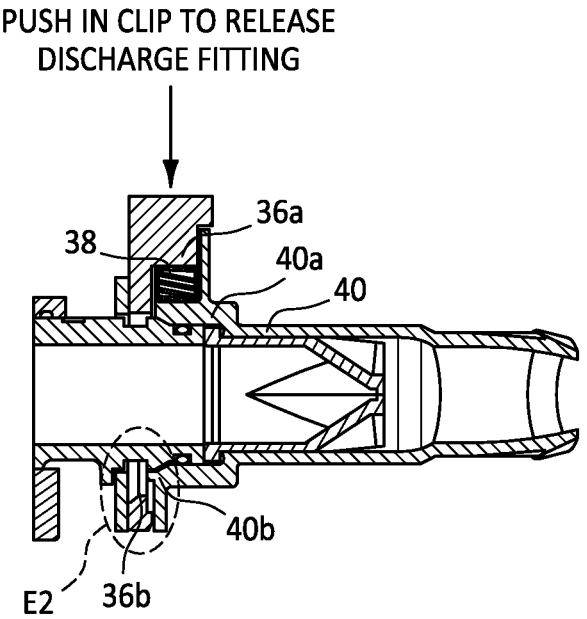
Figure 3F:
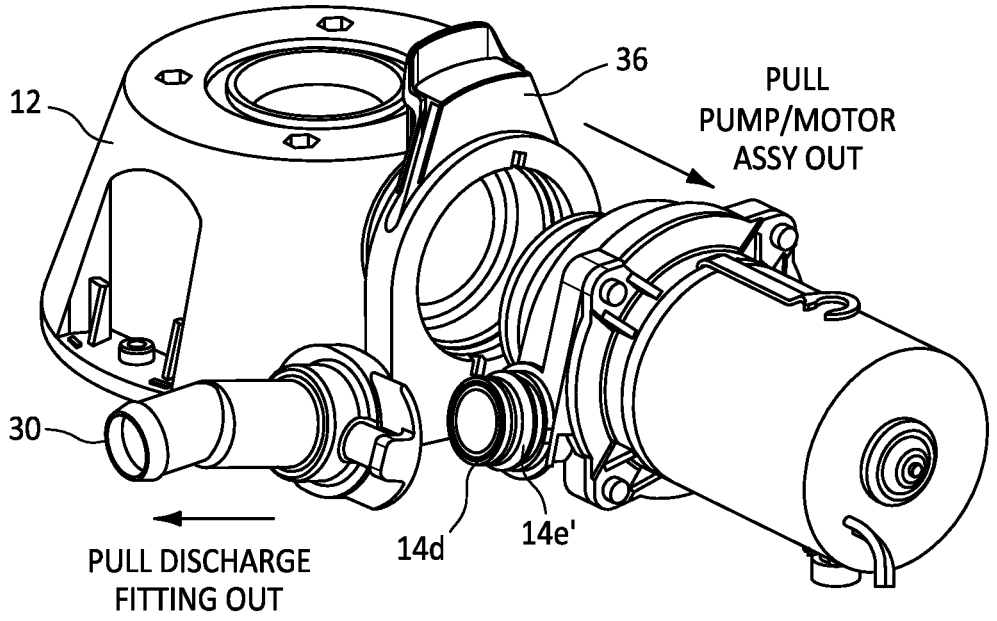

FIG. 3F shows an exploded view of the apparatus shown in FIG. 3C1, e.g., having the pump inlet of the pump/motor assembly pulled out from the toilet base, and also having the discharge fitting pulled out of the pump outlet of the pump/motor assembly, according to some embodiments of the present invention.

FIG. 3G1 shows a partial perspective view of the apparatus shown in FIG. 3C1, e.g., having a discharge fitting portion of the quick release pump/motor assembly configured to be rotated between 0°-180° in relation to, and about a longitudinal axis of, the pump/motor assembly, to orient the discharge fitting in opposite directions as needed depending on the application, according to some embodiments of the present invention.

FIG. 3G2 shows a partial perspective view of the apparatus shown in FIG. 3C1, e.g., having the discharge fitting configured to be rotated 360° in relation to, and about a corresponding longitudinal axis of, the pump outlet, to swivel the discharge fitting as needed depending on the application, according to some embodiments of the present invention.

Figure 3H:
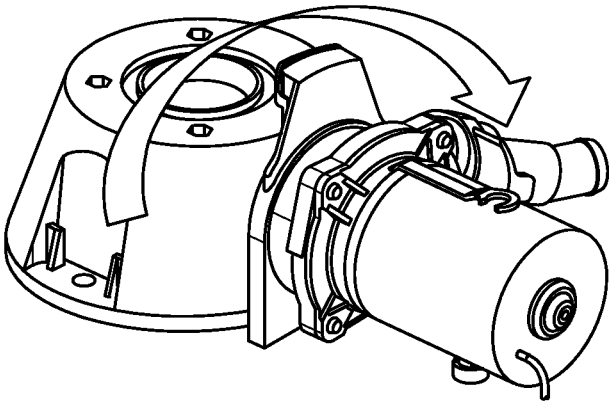
Figure 3H:
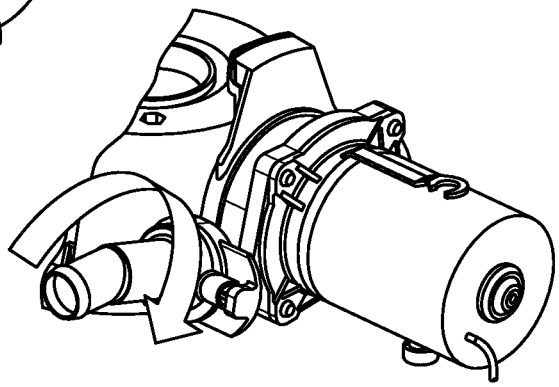
Figure 3H:
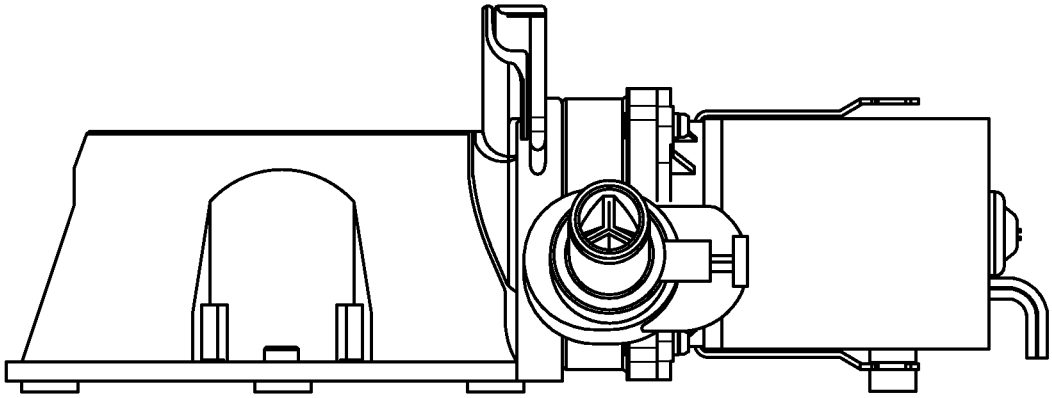

FIG. 3H shows a side view of the apparatus shown in FIG. 3C1, according to some embodiments of the present invention.

Figure 3I:
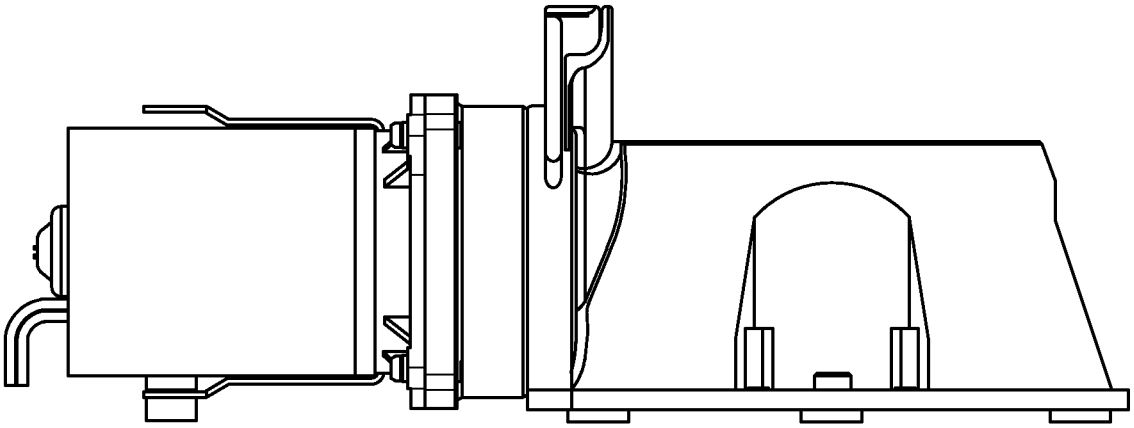

FIG. 3I shows a corresponding side view of the apparatus shown in FIG. 3C1 from the opposite side, according to some embodiments of the present invention.

Figure 3J:
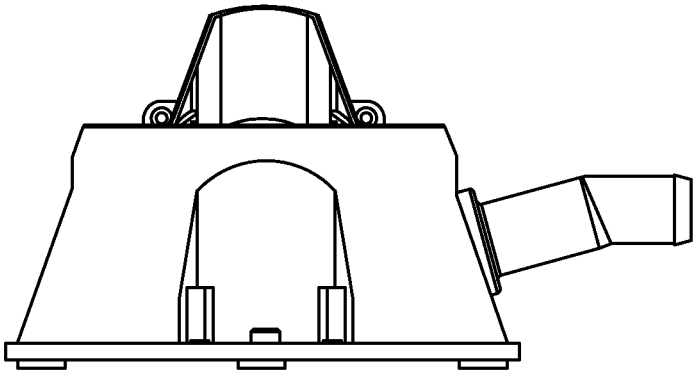

FIG. 3J shows a back view of the apparatus shown in FIG. 3C1, according to some embodiments of the present invention.

Figure 3K:
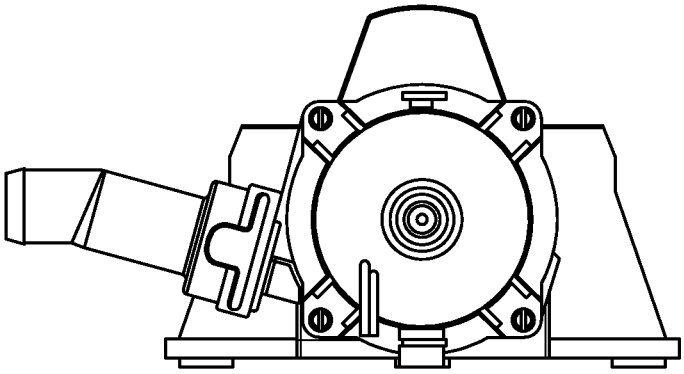

FIG. 3K shows a front view of the apparatus shown in FIG. 3C1, according to some embodiments of the present invention.

Figure 3L:
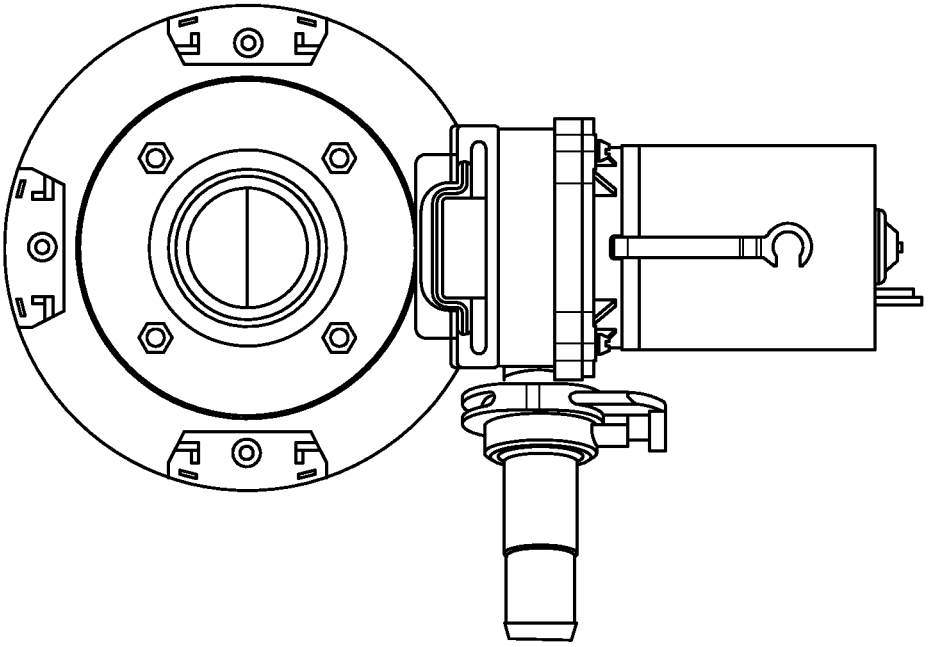

FIG. 3L shows a top view of the apparatus shown in FIG. 3C1, according to some embodiments of the present invention.

Figure 3M:
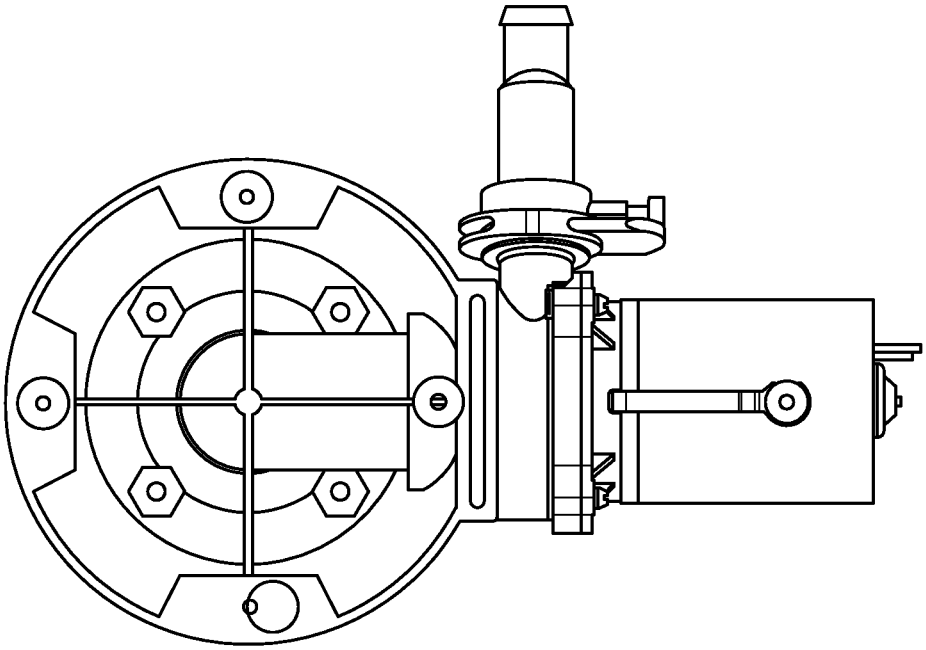

FIG. 3M shows a bottom view of the apparatus shown in FIG. 3C1, according to some embodiments of the present invention.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

By way of example, FIGS. 1, 2A thru 2K and 3A thru 3M show different embodiments of the present invention, which may include, or take the form of, apparatus generally indicated as 10, 10', 10" featuring a toilet base 12, a pump/motor assembly 14 and a quick release coupling mechanism generally indicated as 20. The apparatus 10 may include an electric toilet, e.g., such as a marine electric toilet or an RV electric toilet. The upper part of the electric toilet is not shown, does not form part of the underlying invention, and may include some combination of a toilet bowl, a toilet seat, a flushing mechanism, etc.

The Basic Invention

The toilet base 12 may include a wall **12*a* forming a chamber 12*b* for receiving waste. The wall 12*a* may be configured with, or may include, a toilet base coupling portion 12***c*, e.g., consistent with that set forth herein.

The pump/motor assembly 14 may include a pump inlet generally indicated as 14*a* configured to receive the waste pumped from the chamber 12*b*. The pump inlet 14*a* may include a pump inlet coupling portion 14*b* (e.g., see FIG. 2A) for arranging inside the toilet base coupling portion 12*c* when the pump/motor assembly 14 and the toilet base 12 are coupled together.

The quick release coupling mechanism 20 may include a clip receiving portion 22 and a clip 24. The clip 24 may be configured to slide within the clip receiving portion 22 from a disengage position (see FIG. 2D1, 3C2) to an engage position (see FIG. 2C2, 3B2) to engage the pump inlet coupling portion 14*b* and couple the toilet base 12 and the pump/motor assembly 14 together. The clip 24 may also be configured to slide from the engage position (see FIG. 2C2, 3B2) to the disengage position (see FIG. 2D1, 3C2) to disengage the pump inlet coupling portion 14*b* and decouple the pump/motor assembly 14 from the toilet base 12.

The quick release coupling mechanism 20 may be mounted on the toilet base 12, and/or may include, or may form part of the toilet base coupling portion 12*c*, e.g. consistent with that disclosed herein.

The clip receiving portion 22 may include a slot 22*a* (e.g., see FIG. 2A) configured or formed therein to receive the clip 24. The clip 24 may be configured to slide within the slot 22*a* of the clip receiving portion 22.

The clip receiving portion 22 may include an opening 22*b* configured or formed therein. The pump inlet coupling portion 14*b* may include a rim 14*b*' configured and dimensioned to pass through the opening 22*b* formed in the clip receiving portion 22 and into the toilet base coupling portion 12*c* of the toilet base 12. The clip 24 may be configured to slide within the clip receiving portion 22 from the disengage position (see FIG. 3C2) to the engage position (see FIG. 2C2, 3B2) to engage the rim 14*b*' to couple together the toilet base 12 and the pump/motor assembly 14.

The quick release coupling mechanism 20 may include a spring 26 (see 3D1, 3D2) configured to expand when the clip 24 slides from the disengage position (see FIG. 3C2) to the engage position (see FIG. 3B2) to push and hold the clip 24 in the engage position. The spring 26 (see 3D1, 3D2) may also be configured to compress when the clip 24 is pressed and slides from the engage position to the disengage position to urge the spring 26 back towards the engage position. The spring 26 may be configured between a top portion 24*a* of the clip 24 and an interior portion 28 of the quick release coupling mechanism 20, e.g., as shown in FIGS. 3D1, 3D2. Circled portion D1 show a lower portion of the clip 24 having a detente 24*b* for sliding and contacting a corresponding detent 28*a* of the interior portion 28 of the quick release coupling mechanism 20 for stopping and keeping the clip 24 within the slot 22*a* when the clip 24 is in the engage position. Circled portion D2 show the detente 24*b* of the clip 24 separated from the corresponding detent 28*a* of the interior portion 28 when the clip 24 is in the disengage position. (It is important to note that in operation the clip 24 and detente 24*b* are configured to slide in relation to the corresponding detent 28*a* of the interior portion 28, and are not connect together with the corresponding detent 28*a* of the interior portion 28.)

The clip 24 may include a clip engaging portion 24*c* (see FIG. 3B2) configured to engage the rim 14*b*' when the clip 24 slides from the disengage position (see FIG. 3C2) to the engage position (see FIG. 3B2), and also configured to disengage the rim 14*b*' when the clip 24 slides from the engage position to the disengage position. (In FIG. 3B2, a lower part (not shown) of the rim 14*b*' is engaged and covered by part of the clip engaging portion 24*c* of the clip 24.)

The clip 24 may include a clip release portion 24*d* having an opening 24*d*' configured to allow the rim 14*b*' to pass thru when the clip 24 slides into the disengage position (see FIG. 3C2) for releasing the pump/motor assembly 14 from the toilet base 12, and also for positioning the pump inlet coupling portion 14*b* and rim 14*b*' for engagement. (In FIG. 3C2, the rim 14*b*' is not engaged by any part of the clip—release portion 24*d* of the clip 24.)

The pump/motor assembly 14 may include a pump outlet 14*d* (see FIG. 1) having a pump outlet coupling portion 14*e* (FIG. 3F) configured or formed thereon to provide the waste from the pump/motor assembly 14.

The apparatus 10 may also include a discharge fitting 30 having a quick release discharge fitting coupling mechanism 32 with a discharge fitting clip receiving portion 34 (FIG. 2D1) and a discharge fitting clip 36, e.g., consistent with that shown in FIGS. 2D1, 2D2. The discharge fitting clip 36 may be configured to slide within the discharge fitting clip receiving portion 34 from a discharge fitting disengage position (see FIG. 3C3) to a discharge fitting engage position (see FIG. 2C3, 3B3) to engage the pump outlet coupling portion 14*e* and couple the discharge fitting 30 and the pump/motor assembly 14 together. The discharge fitting clip 36 may also be configured to slide from the discharge fitting engage position (see FIG. 2C2, 3B3) to the discharge fitting disengage position (see FIG. 3C3) to disengage the pump outlet coupling portion 14*e* and decouple the discharge fitting 30 from the pump/motor assembly 14.

The discharge fitting clip receiving portion 34 may include a discharge fitting slot 34*a* (FIGS. 2D1, 2D2) configured or formed therein to receive the discharge fitting clip 36. The discharge fitting clip 36 may be configured to slide within the discharge fitting slot 34*a*.

The discharge fitting clip receiving portion 34 may include an opening 34*b* configured or formed therein. The pump outlet coupling portion 14*e* (see 3F) may include a pump outlet rim 14*e*' configured to pass through the opening 34*b* formed in the discharge fitting clip receiving portion 34 and into the discharge fitting 30. The discharge fitting clip 30 may be configured to slide within the discharge fitting clip receiving portion 34 from the discharge fitting disengage position (see FIG. 3C3) to the discharge fitting engage position (see FIG. 2C3, 3B3) to engage the pump outlet rim 14*e*' of the pump outlet 14*d* to couple together the pump/motor assembly 14 and the discharge fitting 30.

The quick release discharge fitting coupling mechanism 32 may include a discharge fitting spring 38 (see FIG. 3E1, 3E2) that is configured to expand when the discharge fitting clip 36 is pressed and slides from the discharge fitting disengage position (see FIG. 3C3) to the discharge fitting engage position (see FIG. 3B3) to push and hold the discharge fitting clip 36 in the discharge fitting engage position. The discharge fitting spring 38 may also be configured to compress when the discharge fitting clip 36 slides from the discharge fitting engage position to the discharge fitting disengage position to urge the discharge fitting spring 38 back towards the discharge fitting engage position. Similar to the clip 24, the spring 38 may be configured between a top portion 36*a* of the clip 36 and a top portion 40*a* of a discharge fitting housing 40, e.g., as shown in FIGS. 3E1, 3E2. Circled portion E1 shows the discharge fitting clip 36 having a detente 36*b* for engaging a corresponding detente 40*b* of the discharge fitting housing 40 for retaining the discharge fitting clip 36 within the discharge fitting slot 34*a*. Circled portion E2 show the detente 40*b* separated from the corresponding detent 36*b* when the discharge fitting clip 36 is in the disengage position. In operation, the clip 36 and detente 36*b* are configured to slide in relation to the corresponding detent 40*b* and the discharge fitting housing 40.

The discharge fitting clip 36 may include a discharge fitting clip engaging portion 36C (FIG. 3B3) configured to engage the pump outlet rim 14*e*' when the discharge fitting clip 36 slides from the discharge fitting disengage position (see FIG. 3C3) to the discharge fitting engage position (see FIG. 3B3), and also configured to disengage the pump outlet rim 14*e*' when the discharge fitting clip 36 slides from the discharge fitting engage position to the discharge fitting disengage position.

The discharge fitting clip 36 may include a discharge fitting release portion 36*d* (FIG. 3C3) having an opening 36*d*' configured to allow the pump outlet coupling portion 14*e* to pass thru when the discharge fitting clip 36 slides into the discharge fitting disengage position (see FIG. 3C3) for releasing the discharge fitting 30 from the pump/motor assembly 14, and for also positioning the pump outlet coupling portion 14*e* for engagement.

Other Components/Parts

As one skilled in the art would appreciate, the drawing includes other components/parts that are not labeled or described to reduce clutter in the Figures, and do not form part of the underlying invention, e.g., including O-rings (FIG. 1) for sealing the pump inlet 14*a* in relation to the toilet base coupling portion 12*c*; nuts and bolts for coupling different parts of pump, motor and the pump/motor assembly together; etc.

Possible Applications

Possible applications may include marine electric toilets for vessel, or Recreational Vehicle (RV) electric toilets, etc.

The Scope of the Invention

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. An electric toilet comprising:

a toilet base having a wall forming a chamber for receiving waste, the wall having a toilet base coupling portion;

a pump/motor assembly having a pump inlet with a longitudinal axis and configured to receive the waste pumped from the chamber, the pump inlet having a pump inlet coupling portion arranged inside the toilet base coupling portion when the pump/motor assembly and the toilet base are coupled together, the pump/motor assembly having a pump outlet configured to receive a discharge fitting and provide the waste from the pump/motor assembly;

a quick release coupling mechanism having a clip receiving portion and a clip configured to slide within the clip receiving portion from a disengage position to an engage position to engage the pump inlet coupling portion and couple the toilet base and the pump/motor assembly together, configured to slide from the engage position to the disengage position to disengage the pump inlet coupling portion and decouple the pump/motor assembly from the toilet base, the clip configured to engage the clip receiving portion and allow the pump outlet and discharge fitting to rotate between 0°-180° in relation to and about the longitudinal axis of the pump inlet to orient the discharge fitting in opposite directions as needed depending on an application.

2. The electric toilet according to claim 1, wherein the quick release coupling mechanism is mounted on the toilet base, including mounted on the wall of the toilet base or to the toilet base coupling portion of the toilet base.

3. The electric toilet according to claim 1, wherein the clip receiving portion has a slot configured or formed therein to receive the clip; and the clip is configured to slide within the slot of the clip receiving portion.

4. The electric toilet according to claim 1, wherein the clip receiving portion has an opening configured or formed therein;

the pump inlet coupling portion has a rim configured to pass through the opening formed in the clip receiving portion and into the toilet base coupling portion of the toilet base; and the clip is configured to slide within the clip receiving portion from the disengage position to the engage position to engage the rim to couple together the toilet base and the pump/motor assembly.

5. The electric toilet according to claim 1, wherein the quick release coupling mechanism comprises a spring configured to expand when the clip slides from the disengage position to the engage position to push and hold the clip in the engage position, and also configured to compress when the clip slides from the engage position to the disengage position to urge the spring towards the engage position.

6. The electric toilet according to claim 4, wherein the clip comprises a clip engaging portion configured to engage the rim when the clip slides from the disengage position to the engage position, and also configured to disengage the rim when the clip slides from the engage position to the disengage position.

7. The electric toilet according to claim 6, wherein the clip comprises a clip release portion having an opening configured to allow the pump inlet coupling portion to pass thru when the clip slides into the disengage position for releasing the pump/motor assembly from the toilet base, and also for positioning the pump inlet coupling portion for engagement.

8. The electric toilet according to claim 1, wherein the pump outlet has a corresponding longitudinal axis and includes a pump outlet coupling portion; and the discharge fitting includes a quick release discharge fitting coupling mechanism with a discharge fitting clip receiving portion and a discharge fitting clip, the discharge fitting clip configured to slide within the discharge fitting clip receiving portion from a discharge fitting disengage position to a discharge fitting engage position to engage the pump outlet coupling portion and couple the discharge fitting and the pump/motor assembly together, and also from the discharge fitting engage position to the discharge fitting disengage position to disengage the pump outlet coupling portion and decouple the discharge fitting from the pump/motor assembly, the discharge fitting clip configured to engage the discharge fitting clip receiving portion and allow the discharge fitting to rotate 360° in relation to and about the corresponding longitudinal axis of the pump outlet to swivel the discharge fitting as needed depending on the application.

9. The electric toilet according to claim 8, wherein the discharge fitting clip receiving portion has a discharge fitting slot configured or formed therein to receive the discharge fitting clip; and the discharge fitting clip is configured to slide within the discharge fitting slot.

10. The electric toilet according to claim 8, wherein the discharge fitting clip receiving portion has an opening configured or formed therein;

the pump outlet coupling portion includes a pump outlet rim configured to pass through the opening formed in the discharge fitting clip receiving portion and into the discharge fitting; and the discharge fitting clip is configured to slide within the discharge fitting clip receiving portion from the discharge fitting disengage position to the discharge fitting engage position to engage the pump outlet rim to couple together the pump/motor assembly and the discharge fitting.

11. The electric toilet according to claim 8, wherein the quick release discharge fitting coupling mechanism comprises a discharge fitting spring that is configured to expand when the discharge fitting clip slides from the discharge fitting disengage position to the discharge fitting engage position to push and hold the discharge fitting clip in the discharge fitting engage position, and also configured to compress when the discharge fitting clip slides from the discharge fitting engage position to the discharge fitting disengage position to urge the discharge fitting spring towards the discharge fitting engage position.

12. The electric toilet according to claim 10, wherein the discharge fitting clip comprises a discharge fitting clip engaging portion configured to engage the pump outlet rim when the discharge fitting clip slides from the discharge fitting disengage position to the discharge fitting engage position, and also configured to disengage the pump outlet rim when the discharge fitting clip slides from the discharge fitting engage position to the discharge fitting disengage position.

13. The electric toilet according to claim 8, wherein the discharge fitting clip comprises a discharge fitting release portion having an opening configured to allow the pump outlet coupling portion to pass thru when the discharge fitting clip slides into the discharge fitting disengage position for releasing the discharge fitting from the pump/motor assembly, and for also positioning the pump outlet coupling portion for engagement.

14. The electric toilet according to claim 7, wherein the electric toilet is a marine electric toilet or an RV electric toilet.

15. The electric toilet according to claim 1, wherein the electric toilet comprises one or more O-rings configured to seal the pump inlet coupling portion of the pump inlet in relation to the toilet base coupling portion of the toilet base.

16. The electric toilet according to claim 1, wherein the pump outlet has a corresponding longitudinal axis that is perpendicular to the longitudinal axis of the pump inlet.

17. The electric toilet according to claim 8, wherein the electric toilet comprises one or more O-rings configured to seal the pump outlet coupling portion and the quick release discharge fitting coupling mechanism.

18. The electric toilet according to claim 8, wherein the corresponding longitudinal axis of the pump outlet is perpendicular to the longitudinal axis of the pump inlet.

* * * * *